US006889508B2

(12) United States Patent
Leitch et al.

(10) Patent No.: US 6,889,508 B2
(45) Date of Patent: May 10, 2005

(54) HIGH PRESSURE $CO_2$ PURIFICATION AND SUPPLY SYSTEM

(75) Inventors: Kelly Leitch, Nampa, ID (US); Danny Silveira, Tracy, CA (US)

(73) Assignee: The BOC Group, Inc., Murray Hill, NJ (US)

( * ) Notice: Subject to any disclaimer, the term of this patent is extended or adjusted under 35 U.S.C. 154(b) by 15 days.

(21) Appl. No.: 10/670,848

(22) Filed: Sep. 25, 2003

(65) Prior Publication Data

US 2004/0112066 A1 Jun. 17, 2004

Related U.S. Application Data

(60) Provisional application No. 60/415,641, filed on Oct. 2, 2002.

(51) Int. Cl.[7] ..... F17C 7/04

(52) U.S. Cl. ..... 62/48.1; 62/50.5

(58) Field of Search ..... 62/48.1, 48.2, 62/48.3, 49.2, 50.4, 50.5, 606, 617, 908, 928

(56) References Cited

U.S. PATENT DOCUMENTS

| | | | | | |
|---|---|---|---|---|---|
| 3,420,633 | A | | 1/1969 | Lee | |
| 4,337,071 | A | | 6/1982 | Yang | |
| 4,349,415 | A | | 9/1982 | DeFilippi et al. | |
| 4,717,406 | A | | 1/1988 | Giacobbe | |
| 4,806,171 | A | | 2/1989 | Whitlock et al. | |
| 5,028,273 | A | | 7/1991 | Weltmer, Jr. et al. | |
| 5,151,119 | A | * | 9/1992 | Clements et al. | 65/84 |
| 5,339,844 | A | | 8/1994 | Stanford, Jr. et al. | |
| 5,520,000 | A | * | 5/1996 | Pevzner | 62/48.1 |
| 5,582,029 | A | | 12/1996 | Occhialini et al. | |
| 5,775,127 | A | | 7/1998 | Zito | |
| 5,881,557 | A | | 3/1999 | Shields | |
| 5,924,291 | A | * | 7/1999 | Weiler et al. | 62/50.2 |
| 5,925,326 | A | | 7/1999 | Kapoor et al. | |
| 5,934,081 | A | * | 8/1999 | Notaro et al. | 62/50.2 |
| 5,970,554 | A | * | 10/1999 | Shore et al. | 8/158 |
| 6,044,647 | A | * | 4/2000 | Drube et al. | 62/50.1 |
| 6,082,150 | A | | 7/2000 | Stucker | |
| 6,164,088 | A | | 12/2000 | Moriguchi et al. | |
| 6,327,872 | B1 | | 12/2001 | Boyd et al. | |
| 6,336,331 | B1 | * | 1/2002 | White et al. | 62/48.2 |
| 6,505,469 | B1 | * | 1/2003 | Drube et al. | 62/48.1 |
| 6,542,848 | B1 | * | 4/2003 | Neeser et al. | 702/156 |
| 6,612,317 | B2 | | 9/2003 | Costantini et al. | |
| 6,640,556 | B2 | * | 11/2003 | Ursan et al. | 62/50.6 |
| 6,681,764 | B1 | * | 1/2004 | Honkonen et al. | 128/201.21 |
| 6,698,423 | B1 | * | 3/2004 | Honkonen et al. | 128/201.21 |
| 6,742,517 | B1 | * | 6/2004 | Frye et al. | 128/201.21 |
| 2001/0050096 | A1 | | 12/2001 | Costantini et al. | |
| 2003/0072690 | A1 | | 4/2003 | Royer et al. | |
| 2003/0161780 | A1 | | 8/2003 | Howard et al. | |

FOREIGN PATENT DOCUMENTS

| | | | |
|---|---|---|---|
| EP | 0 911 572 A3 | | 4/1999 |
| EP | 0 922 901 A3 | | 6/1999 |
| JP | 355020206 A | * | 2/1980 |
| JP | 360066000 A | * | 4/1985 |
| JP | 361027397 A | * | 2/1986 |

* cited by examiner

*Primary Examiner*—William Doerrler
*Assistant Examiner*—Mohammad M. Ali
(74) *Attorney, Agent, or Firm*—Joshua L. Cohen

(57) ABSTRACT

A batch process and apparatus for producing a pressurized liquid carbon dioxide stream includes distilling a feed stream of carbon dioxide vapor off of a liquid carbon dioxide supply; introducing the carbon dioxide vapor feed stream into at least one purifying filter; condensing the purified feed stream within a condenser to form an intermediate liquid carbon dioxide stream; introducing the intermediate liquid carbon dioxide stream into at least one high-pressure accumulation chamber; heating the high pressure accumulation chamber to pressurize the liquid carbon dioxide contained therein to a delivery pressure; delivering a pressurized liquid carbon dioxide stream from the high-pressure accumulation chamber; and, discontinuing delivery of the pressurized liquid carbon dioxide stream for replenishing the high pressure accumulation chamber.

9 Claims, 2 Drawing Sheets

HIGH PRESSURE $CO_2$ PURIFICATION AND SUPPLY SYSTEM

CROSS-REFERENCE TO RELATED APPLICATIONS

This application claims priority from Provisional Patent Application No. 60/415,641 filed Oct. 2, 2002, which is incorporated herein by reference.

FIELD OF THE INVENTION

The present invention relates to a method and apparatus for producing a purified and pressurized liquid carbon dioxide stream.

BACKGROUND

Highly pressurized, purified liquid carbon dioxide is required for a variety of industrial processes. Such highly pressurized liquid is produced by purifying industrial grade liquid carbon dioxide that is available at about 13 to 23 bar (1.3 to 2.3 MPa) and then pumping the liquid to a pressure of anywhere from between about 20 and about 68 bar (2 to 6.8 MPa). The problem with pumping, however, is that impurities such as particulates or hydrocarbons can be introduced into the product stream as a byproduct of mechanical pump operation.

U.S. Pat. No. 6,327,872, incorporated by reference herein, and assigned to The BOC Group, Inc., the assignee of the present application, is directed to a method and apparatus for producing a pressurized high purity liquid carbon dioxide stream in which a feed stream composed of carbon dioxide vapor is purified within a purifying filter and then condensed within a condenser. The resulting liquid is then alternately introduced and dispensed from two first and second pressure accumulation chambers on a continuous basis, in which one of the first and second pressure accumulation chambers acts in a dispensing role while the other is being filled.

High purity $CO_2$ can be used for the cleaning of optical components using the solvation and momentum transfer effects of $CO_2$ when sprayed onto the optics. These benefits are achieved only if the purity of the $CO_2$ is very high and the $CO_2$ is delivered at a high pressure.

SUMMARY

The present invention relates to a method and apparatus for producing a purified and pressurized liquid carbon dioxide stream in which a feed stream composed of carbon dioxide vapor is condensed into a liquid that is subsequently pressurized, such as by being heated within a chamber.

A batch process is provided for producing a pressurized liquid carbon dioxide stream comprising:

distilling a feed stream comprising carbon dioxide vapor off of a liquid carbon dioxide supply;

introducing the carbon dioxide vapor feed stream into at least one purifying filter;

condensing the purified feed stream within a condenser to form an intermediate liquid carbon dioxide stream;

introducing the intermediate liquid carbon dioxide stream into at least one high-pressure accumulation chamber;

heating said high pressure accumulation chamber to pressurize the liquid carbon dioxide contained therein to a delivery pressure; and, delivering a pressurized liquid carbon dioxide stream from the high-pressure accumulation chamber; and, discontinuing delivery of the pressurized liquid carbon dioxide stream for replenishing the high pressure accumulation chamber.

The process may include venting the high-pressure accumulation chamber to the condenser to facilitate introduction of the intermediate liquid stream into the accumulation chamber. In certain embodiments, the intermediate liquid carbon dioxide stream is accumulated in a receiver prior to introduction into the high-pressure accumulation chamber, and in certain embodiments, the condenser is integral with the receiver.

In one embodiment, the process includes passing the pressurized liquid carbon dioxide stream through a particle filter prior to delivery to a cleaning process.

An apparatus is provided for producing a purified, pressurized liquid carbon dioxide stream comprising:

a bulk liquid carbon dioxide supply tank for distilling off a feed stream comprising carbon dioxide vapor;

a purifying filter for purifying the carbon dioxide vapor feed stream;

a condenser for condensing the carbon dioxide vapor feed stream into an intermediate liquid carbon dioxide stream;

a receiver for accumulating the intermediate liquid carbon dioxide stream;

a high-pressure accumulation chamber for accepting the intermediate liquid carbon dioxide stream from the receiver;

a heater for heating the high-pressure accumulation chamber for pressurizing the carbon dioxide liquid contained therein to a delivery pressure;

a sensor for detecting when the high-pressure accumulation chamber requires replenishment of liquid carbon dioxide;

a flow network having conduits connecting the bulk supply tank, the condenser, the receiver and the high-pressure accumulation chamber and for discharging said pressurized liquid carbon dioxide stream therefrom;

the conduits of said flow network including a vent line from the high-pressure accumulation chamber to the condenser to facilitate introduction of the intermediate liquid carbon dioxide stream into the accumulation chamber; and, the flow network having valves associated with said conduits to allow for isolation of components of the apparatus.

In one embodiment, a particle filter is connected to the flow network to filter the pressurized liquid carbon dioxide stream.

In certain embodiments, the condenser includes an external refrigeration circuit having a heat exchanger to condense the vapor feed stream through indirect heat exchange with a refrigerant stream. In certain embodiments, the condenser is integral with the receiver.

DETAILED DESCRIPTION

An apparatus and process are provided including introducing a feed stream comprising carbon dioxide vapor into a purifying filter, such as for carrying out gas phase purification; condensing the purified $CO_2$ stream, such as by use of mechanical refrigeration or cryogenic refrigerants; isolating the high purity liquid $CO_2$; and, vaporizing a portion of the liquid $CO_2$, such as by using a heater element, to achieve the target pressure.

In one embodiment, the apparatus and process operating cycle is designed to maintain a continuous supply of high-pressure pure liquid carbon dioxide for a period up to about 16 hours, with about 8 hours to reset the system, that is, to replenish the high purity liquid carbon dioxide available for delivery. An example of the operating cycle and corresponding "Modes", and the logic controlling the cycle of the system is presented below in Table 1.

By way of example, in one embodiment, gaseous carbon dioxide is withdrawn from a bulk tank of liquid carbon dioxide, where single stage distillation purification occurs, removing a majority of the condensable hydrocarbons. From the bulk tank, the gaseous carbon dioxide passes through a coalescing filter, providing a second level of purification. The gaseous carbon dioxide is re-condensed in a low-pressure accumulator, providing the third level of purification by removing the non-condensable hydrocarbons. The low-pressure liquid is then transferred to a high-pressure accumulator. Once filled, an electric heater pressurizes the accumulator up to the desired pressure set-point. Upon reaching the pressure set point, the accumulator enters Ready mode (Mode 4, as in Table 1). In one embodiment, the process maintains high purity liquid carbon dioxide to the point of use for a period of up to about 16 hours. After the liquid has been expended, the system may return to Mode 1 and repeat the operating sequence.

Figure 1:
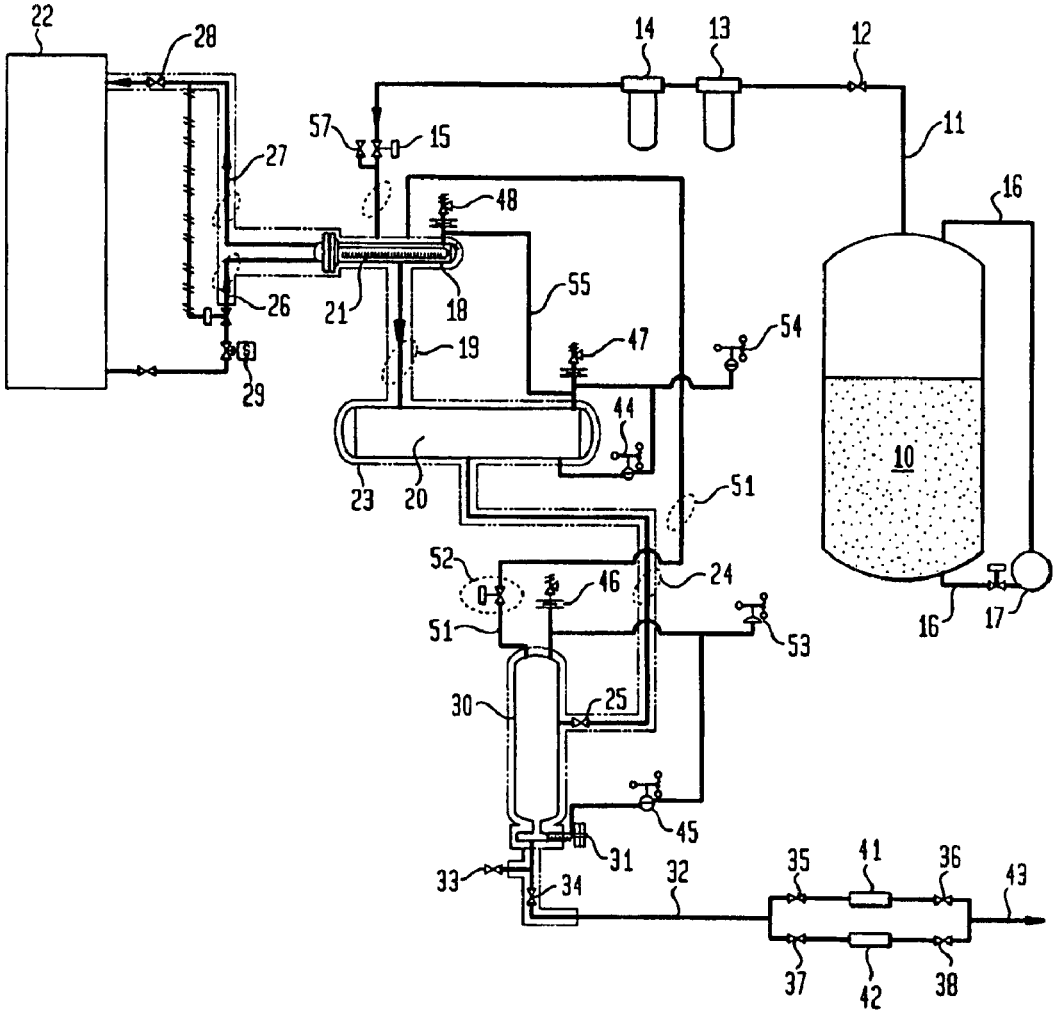
FIG. 1 is a schematic view of an apparatus for carrying out the process according to one embodiment.

With reference to FIG. 1, a carbon dioxide purification and supply apparatus is shown generally at 1. From a bulk supply of liquid carbon dioxide 10, a feed stream 11 comprising carbon dioxide vapor is distilled in a first purification stage, and is introduced into a purifying particle filter 13 and a coalescing filter 14 which can be any of a number of known, commercially available filters, for a second stage purification. Valves 12 and 15 are provided to isolate the purifying filter(s) 13, 14. The bulk supply may be a tank of liquid $CO_2$ maintained at about 300 psig (2.1 MPa) and about 0° F. (−18° C.). As carbon dioxide vapor is drawn out of the bulk supply tank, a portion of the liquid carbon dioxide in the bulk tank is drawn through conduit 16 and introduced to a pressure build device 17 such as an electric or steam vaporizer or the like, to maintain the pressure relatively constant within the bulk supply tank even though carbon dioxide vapor is being removed. The vaporizer takes liquid $CO_2$ from the supply tank and uses heat to change the $CO_2$ from the liquid phase to the gas phase. The resulting $CO_2$ gas is introduced back into the headspace of the supply tank.

The feed stream 11 after having been purified in the second stage is introduced into a condenser 18 that is provided with a heat exchanger 21 to condense the carbon dioxide vapor into a liquid 19. Such condensation is effected by an external refrigeration unit 22 that circulates a refrigeration stream through the heat exchanger, preferably of shell and tube design. Isolation valves 28 and 29 can be provided to isolate refrigeration unit 22 and its refrigerant feed line 26 and return line 27. The liquid carbon dioxide 19 is temporarily stored in a receiver vessel 20, that is, a low pressure accumulator. The level of liquid in the receiver vessel 20 is controlled by a level sensor 44 (such as a level differential pressure transducer) and a pressure sensor 54 (such as a pressure transducer) via a controller (not shown), such as a programmable logic computer.

An intermediate liquid stream comprising high purity $CO_2$ liquid 24 is introduced from the receiver vessel 20 into a high-pressure accumulation chamber 30. The high-pressure accumulation chamber 30 is heated, for example, by way of an electrical heater 31, to pressurize the liquid to a delivery pressure of the pressurized liquid carbon dioxide stream to be produced by apparatus 1.

An insulation jacket 23, such as formed of polyurethane or the equivalent, can be disposed about the condenser 18, the conduit for carrying the liquid $CO_2$ 19, the high pressure accumulation vessel 30, and the outlet conduit 32 and associated valves to maintain the desired temperature of the liquid $CO_2$.

A valve network controls the flow within the apparatus 1. In this regard, fill control valve 25 controls the flow of the intermediate liquid stream from the receiver vessel 20 to the high-pressure accumulation chamber 30. Control of the flow of the high pressure liquid carbon dioxide through outlet conduit 32 is effected by product control valve 34. Drain valve 33 also is connected to outlet conduit 32 for sampling or venting, as needed. The venting of the high-pressure accumulation chamber 30 via vent line (conduit) 51 to the condenser 18 is controlled by vent control valve 52. A pressure relief line 55 from the condenser 18 to the receiver vessel 20 passes vapor from the receiver vessel 20 back to the condenser 18 as liquid carbon dioxide 19 enters the receiver vessel 20.

A pressure sensor 53 (such as a pressure transducer) monitors the pressure and a level sensor 45 (such as a level differential pressure transducer) monitors the level of liquid carbon dioxide within the high-pressure accumulation chamber 30 in order to control the heater 31 for vaporizing a portion of the liquid carbon dioxide, so that a desired pressure of the liquid carbon dioxide can be supplied therefrom. A temperature sensor (not shown) can monitor the liquid carbon dioxide temperature in the heater 31 or accumulation chamber 30.

The process has six operating sequences, or modes, for the high-pressure carbon dioxide accumulator (AC-1). The cycle logic controls the valves, heaters and refrigeration according to these modes. Table 1 lists the possible operation modes.

TABLE 1

High-Pressure Accumulator Status Modes.

| Mode | Designation | Description |
|---|---|---|
| Offline | 0 | All valves closed, heaters off, refrigeration off. |
| Vent | 1 | Depressurize accumulator 30 prior to refilling with low-pressure liquid. Vent valve 52 open. Fill valve 25 and product valve 34 closed. Refrigeration on. |
| Fill | 2 | Filling accumulator 30 with low-pressure liquid. Vent valve 52 and fill valve 25 open. Product valve 34 closed. Refrigeration on. |
| Pressurize | 3 | Pressurizing accumulator 30 up to the set point (i.e. using electric immersion heater 31). Vent, fill and product valves closed. |
| Ready | 4 | System hold at pressure awaits dispensing high pressure liquid. Vent, fill and product valves closed. |
| Online | 5 | System supplying high-pressure liquid. Product valve 34 open. Vent valve 52 and fill valve 25 closed. |

High pressure carbon dioxide from the high pressure accumulator travels through outlet conduit 32 and may be again purified in a further purification stage by one of two particle filters 41 and 42. The particle filters 41 and 42 can be isolated by valves 35,36 and 37,38 respectively, so that one filter can be operational while the other is isolated from the conduit by closure of its respective valves, for cleaning or replacement. The high pressure, purified liquid carbon dioxide stream 43 emerges from the final filtration stage for use in the desired process, such as cleaning of optic elements.

The optical component to be processed is contacted with high purity $CO_2$ directly in a cleaning chamber, such that the contamination residue is dissolved and dislodged by the $CO_2$. The liquid $CO_2$ may be supplied to the cleaning chamber at about 700 psig to about 950 psig (4.8 MPa to 6.6 MPa) or higher.

When the high-pressure accumulation chamber 30 is near empty, as sensed by level sensor 45 and/or the pressure sensor 53, vent control valve 52 opens to vent the high-pressure accumulation chamber. Fill control valve 25 opens to allow intermediate liquid stream 24 to fill the high-pressure accumulation chamber 30. When the differential pressure sensor indicates the completion of the filling, control valves 25 and 52 close, and the liquid carbon dioxide is heated by electrical heater 31 to again pressurize the liquid within the high-pressure accumulation chamber 30.

Pressure relief valves 46,47,48 may be provided for safety purposes, in connection with the high-pressure accumulation chamber 30, receiver vessel 20, and condenser 18, respectively.

Figure 2:
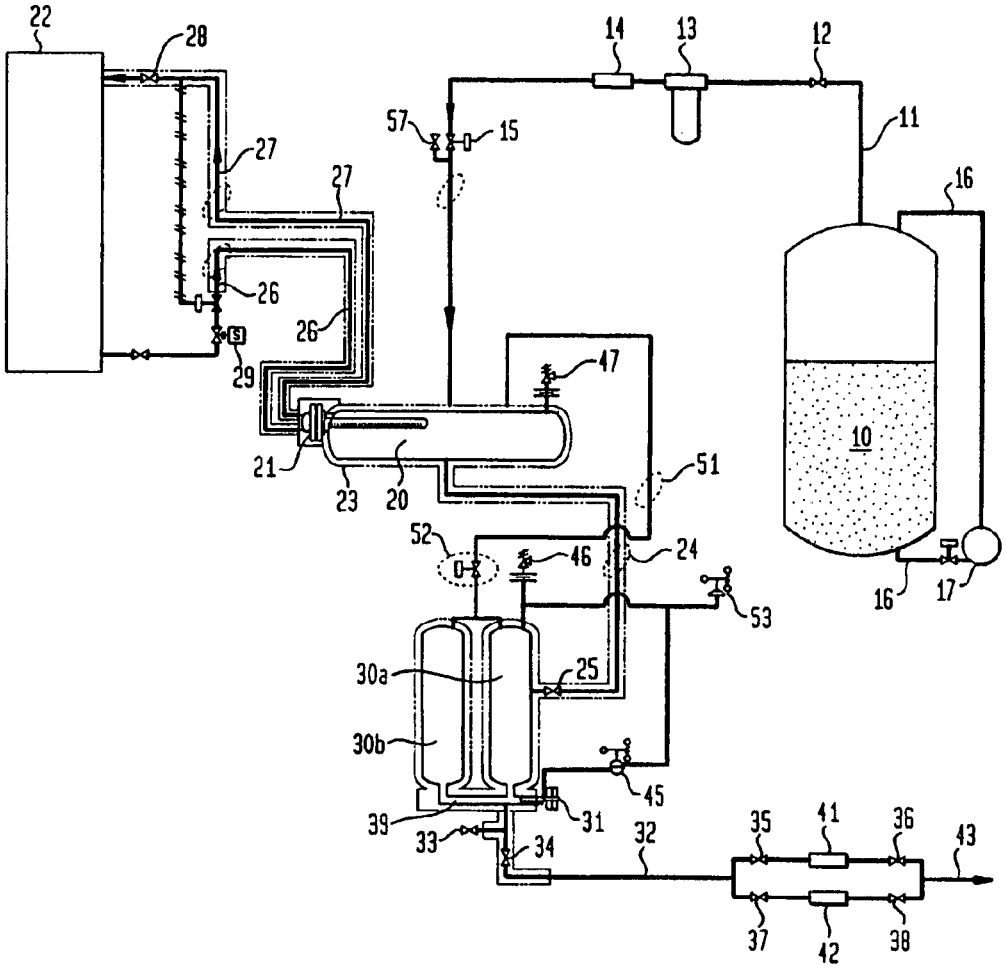
FIG. 2 is a schematic view of an alternative embodiment of an apparatus for carrying out the process.

Other exemplary embodiment(s) of the apparatus are shown in FIG. 2. Elements shown in FIG. 2 which correspond to the elements described above with respect to FIG. 1 have been designated by corresponding reference numbers. The elements of FIG. 2 are designed for use in the same manner as those in FIG. 1 unless otherwise stated.

With reference to FIG. 2, an alternative carbon dioxide purification and supply apparatus is shown generally at 2. From a bulk supply of liquid carbon dioxide 10, a feed stream 11 comprising carbon dioxide vapor is distilled in a first purification stage, and is introduced into a purifying particle filter 13 and a coalescing filter 14 which can be any of a number of known, commercially available filters, for a second stage purification. Valves 12 and 15 are provided to isolate the purifying filter(s) 13,14.

The feed stream 11 after having been purified in the second stage is introduced into the receiver vessel 20 that is provided with a heat exchanger 21 to condense the carbon dioxide vapor into a liquid. Such condensation is effected by an external refrigeration unit 22 that circulates a refrigeration stream through the heat exchanger, preferably of shell and tube design. Isolation valves 28 and 29 can be provided to isolate refrigeration unit 22 and its refrigerant feed line 26 and return line 27. The liquid carbon dioxide is temporarily stored in the receiver vessel 20, that is, a low pressure accumulator.

As may be appreciated, since vapor is being condensed within receiver 20, a separation of any impurities present within the vapor might be effected by which the more volatile impurities would remain in uncondensed vapor and less volatile impurities would be condensed into the liquid. Although not illustrated, sample lines might be connected to the receiver vessel 20 for sampling and drawing off liquid and vapor as necessary to lower impurity concentration within the receiver.

An intermediate liquid stream comprising high purity liquid 24 is introduced into first and second pressure accumulation chambers 30*a* and 30*b*. First and second pressure accumulation chambers 30*a* and 30*b* are heated, preferably by way of electrical heater 31, to pressurize the liquid to a delivery pressure of the pressurized liquid carbon dioxide stream to be produced by apparatus 2.

A valve network controls the flow within the apparatus. In this regard, fill control valve 25 controls the flow of the intermediate liquid stream from the receiver 20 to the high-pressure accumulation chambers 30*a* and 30*b*. Control of the flow of the high pressure liquid carbon dioxide through outlet conduit 32 is effected by product control valve 34. Drain valve 33 also is connected to outlet conduit 32 for sampling or venting, as desired. The venting of the high-pressure accumulation chamber 30 via vent line (conduit) 51 to the condenser 18 is controlled by vent control valve 52.

First and second high pressure accumulation chambers 30*a* and 30*b* may be interconnected by conduit 39 without an isolation valve interposed there between, so that both act effectively as a single unit, at lower cost.

A pressure sensor 53 (such as a pressure transducer) monitors the pressure and a level sensor 45 (such as a level differential pressure transducer) monitors the level of liquid carbon dioxide within the high-pressure accumulators 30*a* and 30*b* in order to control the heater 31 for vaporizing a portion of the liquid carbon dioxide, so that a desired pressure of the liquid carbon dioxide can be supplied therefrom.

High pressure carbon dioxide from the high pressure accumulator travels through outlet conduit 32 and is again purified in a further purification stage by one of two particle filters 41 and 42. The particle filters 41 and 42 can be isolated by valves 35,36 and 37,38 respectively, so that one filter can be operational while the other is isolated from the conduit by closure of its respective valves, for cleaning or replacement. The high pressure, purified liquid carbon dioxide stream 43 emerges from the final filtration stage for use in the desired process as described above. When the requirement for the purified carbon dioxide stream 43 is no longer needed, or can no longer be met, the apparatus begins a replenishment cycle. That is, after Mode 5 is complete, the system can return sequentially to Mode 1, Mode 2, and so on, as set forth in Table 1.

Further features of the apparatus and process include a fully automated microprocessor controller which continuously monitors system operation providing fault detection, pressure control and valve sequencing, ensuring purifier reliability, while minimizing operator involvement. By way of example and not limitation, level sensors 44,45, pressure sensors 53,54, and temperature sensors can provide information for the controller, in order to provide instructions to flow control valves 15,34,52, or pressure relief valves 46,47,48. The valves in the apparatus may be actuated pneumatically, by pulling a tap off of the $CO_2$ vapor conduit such as at valve 57, to supply gas for valve actuation.

The apparatus may include system alarms to detect potential hazards, such as temperature or pressure excursions, to ensure system integrity. Alarm and warning conditions may be indicated at the operator interface and may be accompanied by an alarm beeper. A human machine interface displays valve operation, operating mode, warning and alarm status, sequence timers, system temperature and pressure, heater power levels, and system cycle count.

In summary, industrial grade $CO_2$ gas may be pulled off of the head space of a supply tank where the supply tank acts as a single stage distillation column (Stage 1). The higher purity gas phase is passed through at least a coalescing filter, reducing the condensable hydrocarbon concentration and resulting in a higher level of purity (Stage 2). Stage 3 includes a mechanical or cryogenic refrigeration system to effect a phase change from the gas phase back to the liquid phase. All non-condensable hydrocarbons and impurities are thus removed from the operative carbon dioxide liquid stream.

The subject apparatus and process permits cyclic operation of the process, rather than continuous feed operation. The apparatus and process is also of a more economical design (by approximately half) due to the reduction from continuous or multi-batch to single batch operation. The apparatus and process is further of a more economical design than prior art systems, due to the omission of accessory equipment like boilers and condensers. The reduced footprint allows for location of the apparatus closer to the point of use, resulting in less liquid carbon dioxide boil-off.

It will be understood that the embodiment(s) described herein is/are merely exemplary and that a person skilled in the art may make many variations and modifications without departing from the spirit and scope of the invention. All such modifications and variations are intended to be included within the scope of the invention as described herein. It should be understood that the embodiments described above are not only in the alternative, but can be combined.

We claim:

1. An apparatus for producing a purified, pressurized liquid carbon dioxide stream comprising:

a bulk liquid carbon dioxide supply tank for distilling off a feed stream comprising carbon dioxide vapor;

a purifying filter for purifying the carbon dioxide vapor feed stream;

a condenser for condensing the carbon dioxide vapor feed stream into an intermediate liquid carbon dioxide stream;

a receiver for accumulating the intermediate liquid carbon dioxide stream;

a high-pressure accumulation chamber for accepting the intermediate liquid carbon dioxide stream from the receiver;

a heater for heating the high-pressure accumulation chamber for pressurizing the carbon dioxide liquid contained therein to a delivery pressure;

a sensor for detecting when the high-pressure accumulation chamber requires replenishment of liquid carbon dioxide;

a flow network having conduits connecting the bulk supply tank, the condenser, the receiver and the high-pressure accumulation chamber and for discharging the pressurized liquid carbon dioxide stream therefrom;

the conduits of said flow network including a vent line from the high-pressure accumulation chamber to the condenser to facilitate introduction of the intermediate liquid carbon dioxide stream into the accumulation chamber; and, the flow network having valves associated with said conduits to allow for isolation of components of the apparatus.

2. The apparatus of claim 1, further comprising a particle filter connected to the flow network to filter the pressurized liquid carbon dioxide stream.

3. The apparatus of claim 1, wherein the condenser includes an external refrigeration circuit having a heat exchanger to condense the vapor feed stream through indirect heat exchange with a refrigerant stream.

4. The apparatus of claim 1, wherein the condenser is integral with the receiver.

5. The apparatus of claim 1, wherein the heater comprises an electrical heater.

6. The apparatus of claim 1, wherein the purifying filter for the carbon dioxide vapor feed stream is a coalescing filter.

7. The apparatus of claim 1, wherein the purifying filter for the carbon dioxide vapor feed stream is a particle filter.

8. The apparatus of claim 1, wherein the sensor is a level sensor.

9. The apparatus of claim 1 wherein the sensor is a pressure sensor.

* * * * *